United States Patent [19]

Eckert

[11] 4,453,528

[45] Jun. 12, 1984

[54] ARROW REST

[76] Inventor: William Eckert, 1464 Old Bethlehem Pike, Quakertown, Pa. 18951

[21] Appl. No.: 424,204

[22] Filed: Sep. 27, 1982

[51] Int. Cl.[3] ..... F41B 5/00

[52] U.S. Cl. ..... 124/41 A

[58] Field of Search ..... 124/24 R, 41 A, 88, 124/DIG. 1

[56] References Cited

U.S. PATENT DOCUMENTS

| | | | |
|---|---|---|---|
| 3,504,659 | 4/1970 | Babington | 124/24 R |
| 4,287,868 | 9/1981 | Schiff | 124/24 R X |
| 4,318,390 | 3/1982 | Trotter | 124/41 A |
| 4,332,232 | 6/1982 | Troncoso | 124/41 A X |
| 4,334,409 | 8/1982 | Barner | 124/41 A X |

*Primary Examiner*—Richard J. Apley

*Assistant Examiner*—William R. Browne

*Attorney, Agent, or Firm*—Ruth Moyerman

[57] ABSTRACT

A collapsible arrow rest attached at the handle of a recurve, compound, or the like, archery bow is disclosed. Action of the arrow rest is determined by an elastic cord from the arrow rest to the bow string. An elevation adjusting device is attached to a bracket supporting an arrows rest arm so as to vary the amount of upward pivot of the arrow rest arm with the same amount of draw. Drawing the bow string causes the concave, notched receiving arm to pivot upward, forming an arrow rest. Release of the bow string collapses the receiving arm, allowing an unobstructed flight path for the arrow's shaft and fletching. The arrow rest has lateral and elevation adjustments for desired flight trajectory.

10 Claims, 7 Drawing Figures

ARROW REST

BACKGROUND OF THE INVENTION

1. Field of the Invention

This invention relates to archery equipment, and more particularly to an arrow rest for a recurve, compound, or the like, archery bow.

2. Description of the Prior Art

Avid archers employ the use of many accessories in their quest for shooting accuracy, ease and dependability. Such accessories include stabilizers, sights, mechanical releases and the aforementioned arrow rest. Each accessory must compliment and work in harmony with the others in order to attain the accuracy required by the archer.

Arrow rests for archery bows are well known to the schooled archer. However, those in existence today have flaws. Stationary rests tend to hinder or obstruct the arrow's flight path, thereby reducing the desired accuracy. Still another proposed provision envisions a collapsable arrow rest released by the shock of the bow. The bow shock can affect the stabilizers, release pressure, and bow sway causing an adverse effect on the arrow's accuracy. The aforementioned proposed collapsable arrow rest must be recocked after each successive shot causing a time lapse and interference in the archer's shooting rhythm.

U.S. Pat. No. 3,935,854 and U.S. Pat. No. 3,865,096, both to Troncoso, Jr., are examples of stationary rests. U.S. Pat. No. 4,344,409 to Barner envisions a collapsible arrow rest that works on the shock of the bow and requires recocking preceeding each shot.

There is, therefore, a great need for an improved arrow rest that works harmoniously with all other chosen archery accessories, provides proper arrow shaft and fletch clearance, is convenient to use and at the same time, improves the arrow's accurate trajectory.

SUMMARY OF THE INVENTION

The aforementioned prior art problems are overcome by the improved, collapsible arrow rest of this invention.

The improved arrow rest comprises a mounting bracket that is quickly and adjustably attached by a bolt to a bow's pre-drilled mounting hole at the bow's handle. The rod, slidably connected to the bracket and transcendly spanning the bow's handle, provides the lateral adjustment to accommodate arrow shafts of various diameters and any fletching designs.

The forwardly projecting arrow receiving arm, with its concave forward end notched, acts as the actual rest for the arrow's shaft during the backward draw of the bow's string or cable (hereinafter referred to only as string). The arm's pivotal attachment at generally right angles to the rod allows the receiving arm to move from a downward to upward position and return during the pull and release of the bow string. The elevation adjusting means controls the upward pivot, thereby establishing the desired arc of the arrow's flight path.

The spring tensioning means mounted on the rod and linked to the receiving arm normally holds the receiving arm in a downward pivot allowing the arrow's free flight. The connecting means from the receiving arm to the bow's string is adapted to override the spring's tension when the bow string is drawn. The overriding tension causes the receiving arm to pivot upward, providing an arrow rest. The connecting means is adjustably attached to the string in order to adjust the time at which the receiving arm collapses, thus improving the arrow's stability.

The release of the string causes the spring tension to relax, returning the arrow receiving arm to its normally downward pivot, thus allowing the arrow's free flight and immediate readiness to receive another arrow.

It is, therefore, an object of this invention to provide a device that is compatible with all other archery accessories an archer may choose to use including mechanical releases.

It is a further object of this invention to provide a device in which arrows with shafts of any diameter or fletching arrangements will have an unobstructed flight path.

It is still another object of this invention to provide a device with upward and lateral adjustments for desired trajectory.

It is yet another object of this invention to provide a device that automatically sets and resets itself during operation.

It is yet another object of this invention to provide a collapsible device that reacts to the positioning of the connecting means and not the shock of the bow.

It is still another object of this invention to provide a device that can be used for right or left handed archers through producing a simple mirror image of only the rod and receiving arm.

These and other objects will be more readily ascertainable to one skilled in the art from a consideration of the following Figures, description and exemplary embodiments.

BRIEF DESCRIPTION OF THE PREFERRED EMBODIMENTS

DETAILED DESCRIPTION OF THE PREFERRED EMBODIMENT(S)

Figure 1:
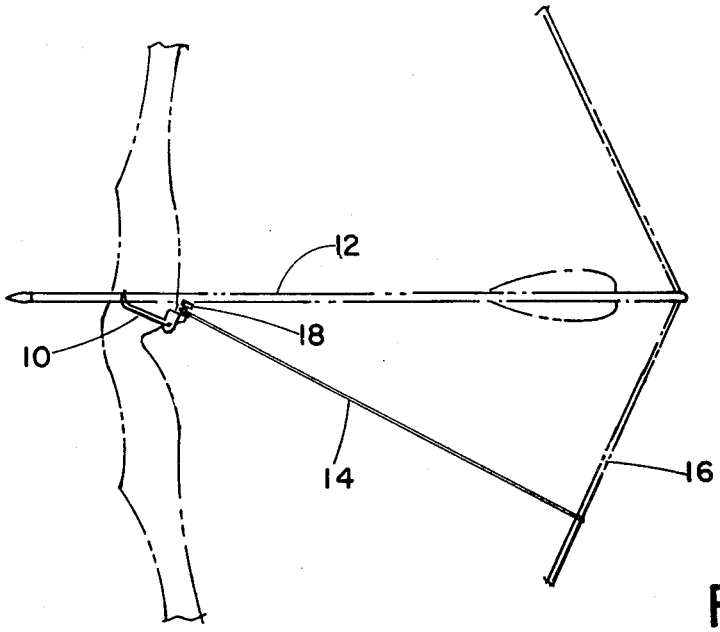
FIG. 1 is a schematic side view of the arrow rest of this invention mounted on a bow with bow string drawn.

Referring now to the drawings and more particularly to FIG. 1, the arrow rest device of this invention is shown with arrow receiving arm 10 in an upward pivot, supporting arrow 12 with bow string drawn just before release. Connecting means 14, which is preferably an elastic band, is fastened to bow string 16 and elevation adjusting screw 18. Screw 18 is mounted in receiving arm 10 and receiving arm 10, because of the tension induced by connecting means 14, is biased upward supporting arrow 12.

Figure 2:
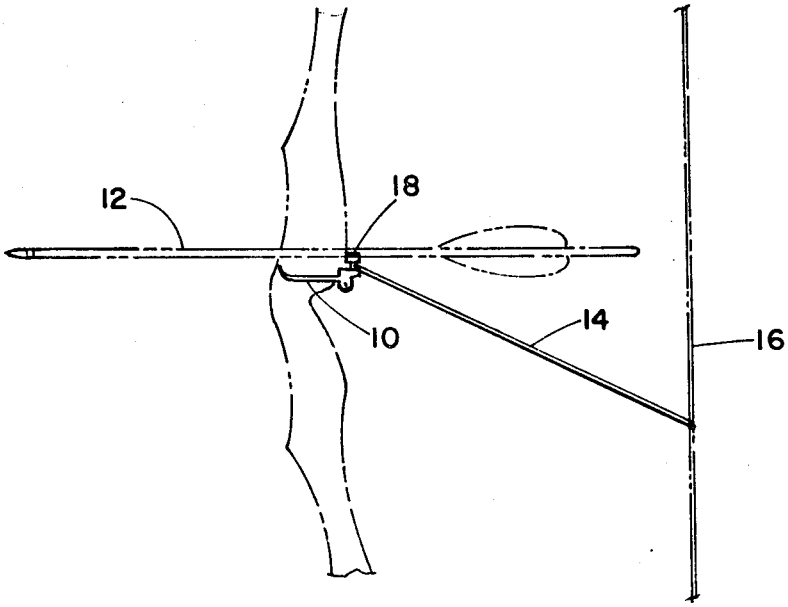
FIG. 2 is a schematic side view of the arrow rest of this invention mounted on a bow with bow string at rest.

Referring now to FIG. 2, the arrow rest device is shown with arrow receiving arm 10 in a downward, biased, pivot, allowing free flight of arrow 12 and in this Figure, arrow 12 is shown in flight. Connecting means 14, linked to bow string 16, is in its released, or slack, position and therefore receiving arm 10 has dropped to allow clear passage of the arrow.

Figure 3:
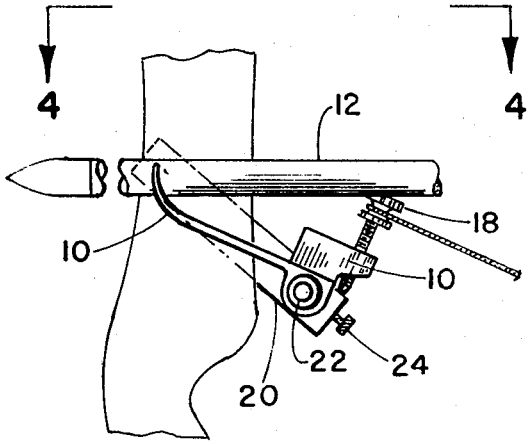
FIG. 3 is a fragmentary enlargement of FIG. 1.

Referring now to FIG. 3, a fragmentary enlargement of FIG. 1, arrow receiving arm 10 is shown in an upward pivot, supporting arrow 12. Rod 22 slidably connects arrow receiving arm 10 to mounting bracket 20 as may be more clearly seen in FIG. 7. Rod 22 is held in place to bracket 20 by locking screw 24 and this feature allows the arrow rest to be used on varying size bows by merely adjusting arm 10 along rod 22. Elevation adjusting screw 18 allows bracket 20 to control the upward pivot of receiving arm 10 and by turning the screw, the user can fine tune the alignment of the arrow.

Figure 4:
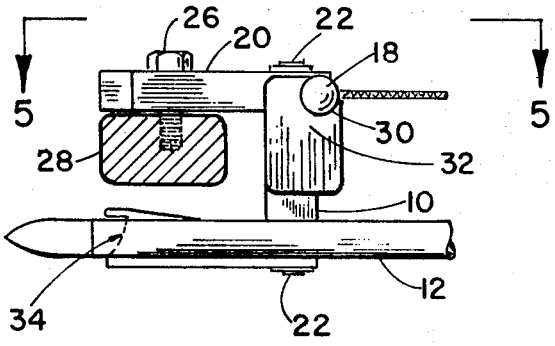
FIG. 4 is a top cross section taken along lines 4—4 of FIG. 3.

Referring now to FIG. 4, a top cross section view of the arrow rest is shown along lines 4—4 of FIG. 3. In this view, the fit of the device around the bow is more readily ascertainable. Mounting bracket 20, secured to bow handle 28 by bolt 26, can be seen to advantage in this view. Elevation adjusting screw 18 is shown from the top screwed through aperture 30 and in this view, auxiliary aperture 32, for use in lateral adjustment, can be seen. Forwardly projecting arrow receiving arm 10 is shown including notch 34, shown partially in phantom. Notch 34 contains arrow 12 and is also shown more clearly in FIG. 7. It may be seen in this view that receiving arm 10's pivotal attachment is at generally right angles to rod 22 and also that mounting bracket 20 and receiving arm 10 are mounted on opposing sides of bow handle 28.

Figure 5:
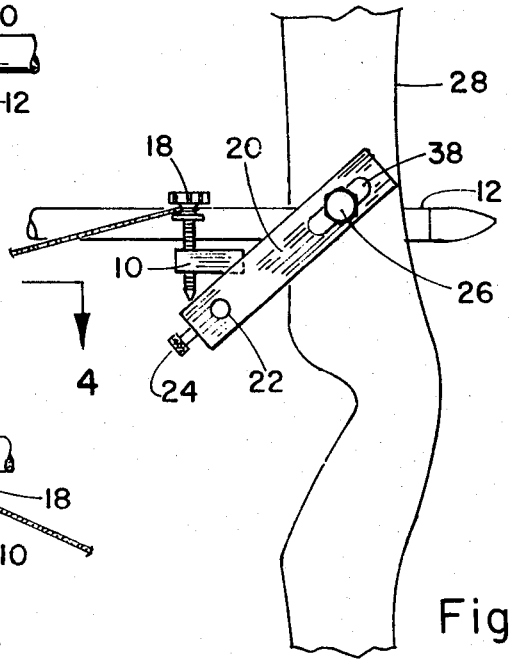
FIG. 5 is a section taken along lines 5—5 of FIG. 4.

Referring now to FIG. 5, a section taken a lines 5—5 of FIG. 4 is shown. FIG. 5 best illustrates the position of mounting bracket 20. Mounting bracket 20 is secured to bow handle 28 by bolt 26 through slot 38 and may be adjusted along the slot. Elevation adjusting screw 18 integral to arrow receiving arm 10 is shown with its point touching mounting bracket 20.

Figure 6:
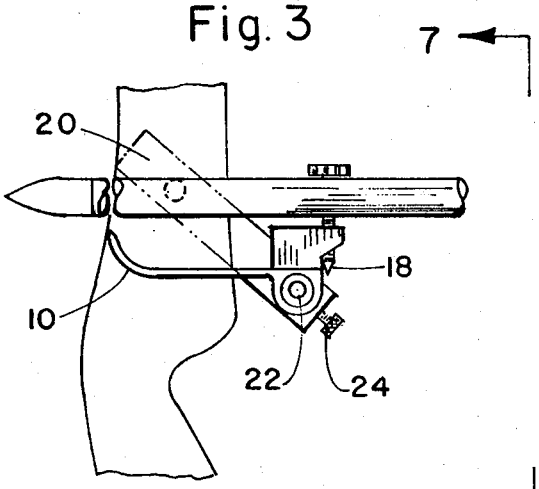
FIG. 6 is a fragmentary enlargement of FIG. 2.
Figure 7:
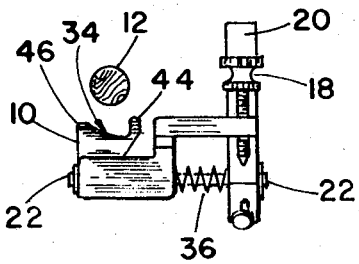
FIG. 7 is an end view taken on lines 7—7 of FIG. 6.

Referring now to FIGS. 6 and 7, the device of this invention is shown with arrow 12 in flight. In FIG. 6, a fragmentary enlargement of FIG. 2, arrow receiving arm 10 is in a downward pivot position allowing free flight of arrow 12. This downward pivot position is bias, or spring, induced. Rod 22 and locking screw 24 are also visible in this view. Elevation adjusting screw 18 is integral to receiving arm 10 and is not engaged with mounting bracket 20 in this view due to the downward pivot of arrow receiving arm 10.

Referring now to FIG. 7, an end view taken along lines 7—7 of FIG. 6, arrow 12 is shown in flight completely clear of arrow receiving arm 10 which is in its downward pivot. Helical tensioning means 36 mounted on rod 22 is linked to receiving arm 10 and operates to insure arrow receiving arm 10 remains downward unless pulled upward by connecting means 14. Elevation adjusting screw 18 is clearly shown not engaged with mounting bracket 20 due to the bias of helical tensioning means 36. FIG. 7 also best illustrates the configuration of notch 34 with tine 44 being generally vertical and tine 46 is shown as less than a 90 degree angle.

There are many variations which may be practiced within the scope of this invention. While the use of other accessories, especially mechanical releases, are harmonious, none are necessary.

An elastic cord is suggested as a connecting means, but any stretch material would be satisfactory.

The device has few moving parts, and numerous materials, particularly plastic, would be suitable for its inexpensive manufacture yet provide durable dependability.

The arrow rest of this invention has many advantages. The device design need not be changed for left-handed archers, only a mirror image product is required.

The concave notch, while not critical for overall use, is of particular benefit in holding the arrow in place.

The figures illustrate a generally vertical tine proximate the bracket while the other tine is preferably less than a 90 degree angle.

Having now described my invention, it is not intended that such description be limiting, but rather that the invention be limited only by a reasonable interpretation of the apended claims.

What is claimed is:

1. An arrow rest device for a recurve, compound or the like, archery bow comprising:

(a) a mounting bracket adjustably attachable to a bow's handle;

(b) a rod of sufficient length to transcendly span said bow's handle, said rod including a slidable connection to said bracket;

(c) a forwardly projecting arrow receiving arm pivotally attached at generally right angles to said rod, said bracket and said receiving arm mountable on opposing sides of said bow's handle;

(d) an elevation adjusting means integral with said receiving arm to control the amount of upward pivot of said arm with the same amount of draw;

(e) a spring tensioning means mounted on said rod and linked to said receiving arm to cause said arm to be normally biased in a downward pivot during an arrow's flight path; and, (f) connecting means from said receiving arm to said bow's string, said connecting means adapted to override said spring's bias when said bow string is drawn so that said receiving arm pivots upward to provide an arrow rest, whereby, when said bow string is released, said spring tension is relaxed returning said arrow receiving arm to its normally downward pivot, allowing said arrow's free flight.

2. The device according to claim 1 wherein said mounting bracket includes a slot for receiving a bolt.

3. The device according to claim 1 wherein said slideable connection includes apertures perpendicularly mounted with respect to each other on said bracket, one for receiving said rod at right angles and another for receiving a locking screw to secure lateral adjustment of said rod.

4. The device according to claim 1 wherein said receiving arm's forward end is concave.

5. The device according to claim 4 wherein said forward concave end is notched.

6. The device according to claim 5 wherein said notch of includes a generally vertical tine proximate said bracket and an other side of generally less than a 90 degree angle to insure certain containment of said arrow during the draw of said bow string.

7. The device according to claim 1 wherein said elevation adjusting means is a screw through at least one aperture in said receiving arm and aligned to engage said mounting bracket.

8. The device according to claim 1 wherein said tensioning means is helical.

9. The device according to claim 1 wherein said connecting means is an elastic cord.

10. The device according to claim 9 wherein said connecting means is adjustable to alter the timing of said receiving arm's downward pivot.

* * * * *